United States Patent [19]

Abbott

[11] 3,983,041

[45] Sept. 28, 1976

[54] RUST INHIBITOR FOR MONO- OR POLYUREA GREASES

[75] Inventor: Andrew D. Abbott, Greenbrae, Calif.

[73] Assignee: Chevron Research Company, San Francisco, Calif.

[22] Filed: Jan. 22, 1976

[21] Appl. No.: 651,664

Related U.S. Application Data

[63] Continuation-in-part of Ser. No. 560,277, March 19, 1975, abandoned.

[52] U.S. Cl. ..... 252/17; 252/25; 252/51.5 R; 252/51.5 A; 252/403

[51] Int. Cl.[2] ..... C10M 3/18; C10M 5/14; C10M 7/20; C10M 7/24

[58] Field of Search ..... 252/17, 25, 51.5 R, 252/51.5 A, 403

[56] References Cited

UNITED STATES PATENTS 3,868,329 2/1975 Brown et al. ..... 252/17

*Primary Examiner*—Delbert E. Gantz
*Assistant Examiner*—I. Vaughn
*Attorney, Agent, or Firm*—G. F. Magdeburger; C. J. Tonkin

[57] ABSTRACT

An improved grease composition is disclosed and comprises a novel combination of a Mannich base, a poly- or monourea thickener and an alkaline earth metal carbonate or carboxylate within a lubricating oil. The Mannich base is prepared by reacting formaldehyde, alkylphenol and an amine selected from dialkanolamine, N,N-dialkanol-alkylenediamine and alkylamine.

12 Claims, No Drawings

RUST INHIBITOR FOR MONO- OR POLYUREA GREASES

CROSS REFERENCE TO RELATED APPLICATIONS

This application is a continuation-in-part of U.S. application Ser. No. 560,277, filed Mar. 19, 1975 and now abandoned.

BACKGROUND OF THE INVENTION

Modern technology is currently supplying the general public and the process industries with machinery capable of operating under severe conditions. Many of these machines require lubricants having properties which are not available with the conventional greases and oils. Thus, modernization of the mechanical devices has strained the petroleum industry for the development of a second generation of lubricants capable of satisfying the lubricating requirements of the new machines.

Recently, a new grease composition has been developed containing a novel mono- or polyurea thickening agent. This grease has been found to exhibit superior endurance and high-temperature lubricating properties. The polyurea thickening agent is disclosed in U.S. Pat. Nos. 3,243,210 and 3,243,372. More recently, advances in the polyurea grease art have resulted in the formulation of an improved polyurea grease containing an alkaline earth metal carboxylate (see, for example, U.S. Pat. Nos. 3,846,314 and 3,846,315).

While this grease solves many of the problems associated with the older lubricants, it is handicapped by rusting properties. This is a typical problem associated with most multipurpose grease thickeners. Rusting is a major problem in many machines exposed to a corrosive environment. To combat the rust problems, conventional rust inhibitors have been incorporated into the greases. The conventional inhibitors, however, are quite selective for the particular grease involved and often interfere with the essential properties of the grease. For example, some inhibitors may impart satisfactory rust inhibition but only at the expense of adversely softening the grease. Conversely, some inhibitors may be quite compatible with the grease but are relatively ineffective in rust protection. Some additives have been developed which exhibit good rust inhibition, but when incorporated into a mono- or polyurea and metal carboxylate-containing grease form grit or small particulate matter in the grease. One such additive is disclosed in U.S. Pat. No. 3,868,329 which is directed to a Mannich base prepared by reacting phenol with formaldehyde and certain amines; while this additive is an effective rust inhibitor in polyurea greases, it tends to cause the formation of grit in the grease.

It is, therefore, an object of this invention to provide an improved grease composition.

It is an additional object to provide a mono- or polyurea-metal carboxylate grease composition containing a compatible rust inhibitor.

It is another object of this invention to provide a mono- or polyurea and metal carboxylate-containing grease which has improved rust inhibition and which does not contain substantial amounts of grit.

Other objects and their attendant advantages will become apparent from the following description of the invention and appended claims.

SUMMARY OF THE INVENTION

The aforementioned objects can be realized by incorporating into a mono- or polyurea and alkaline earth metal carboxylate- or carbonate-containing grease a minor amount of a Mannich base prepared by reacting a low-molecular-weight alkylphenol with formaldehyde and an amine selected from the class consisting of dialkanolamine, N,N-dialkanolalkylenediamine and dialkylamine. The molar ratio of formaldehyde to amine to alkylphenol in the Mannich base product should preferably be between about 0.5–5:0.5–5:1.

By incorporating this particular Mannich base into the mono- or polyurea and metal carboxylate- or carbonate-containing grease, the rust inhibition of the grease is significantly increased. Concomitantly, the other physical properties of the novel grease are not seriously affected. I have also found that the Mannich base does not promote grit formation within the grease. Thus, an improvement is obtained over the grease compositions of U.S. Pat. No. 3,868,329.

DETAILED DESCRIPTION OF THE INVENTION

The improved grease composition of the present invention can be realized by admixing in a major portion of a lubricating oil from 0.5 to 20 weight percent of a mono- or polyurea thickener, from 3 to 30 weight percent of an alkaline earth metal carboxylate having from 1 to 3 carbons or carbonate, and from 0.1 to 10 weight percent of a Mannich base. The Mannich base is a mixture of compounds prepared by reacting a low-molecular-weight alkanol, formaldehyde and an amine. It is believed that a major portion of the compounds have the following generalized structure:

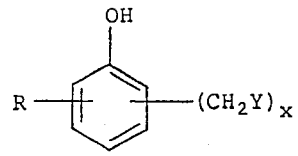

wherein $x$ is an integer from 1 to 3 and preferably from 1 to 2; R is a $C_1$–$C_4$ alkyl and preferably methyl, Y is a univalent amino radical selected from the group consisting of

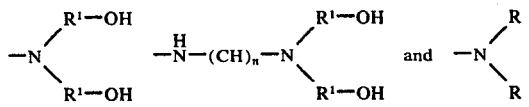

and wherein $n$ is an integer from 1 to 4 and preferably from 2 to 3 and $R^1$ is a $C_2$–$C_4$ alkene and preferably ethylene and R is the same as defined above.

The above structural formula represents a broad and simplified version of the Mannich base useful in the practice of this invention. The product is a mixture of compounds wherein $x$ varies from 1 to 3. In addition, minor amounts of compounds not described by the above formula may be present, e.g., compounds wherein the hydroxyl unit on the alkylphenol group enters into a reaction with the formaldehyde or amine co-reactant, etc. Other reactions between the 3 reactants or any 2 of them may may also take place and be present in the mixture. Thus, it is apparent that while the above chemical formula is descriptive of the majority of the compounds within the mixture, it should not be interpreted as limiting the invention to the compounds having exact structure as shown. The preferred Mannich base is prepared by reacting p-cresol, formaldehyde and diethanolamine.

The alkylphenol reactant may have from 1 to 4 carbons in the alkyl group and may be in the ortho, para or meta position to the hydroxyl group. Exemplary alkylphenols include p-ethylphenol, m-ethylphenol, p-butylphenol, p-propylphenol, o-propylphenol, etc.

Cresol is preferred, and may be p-cresol or m-cresol or mixtures thereof. A mixture of the cresols is most preferred. The o-cresol may be used, but is less preferred.

The compounds are prepared by contacting alkylphenol, formaldehyde and amine in a suitable reactor at a temperature of 150° to 400°F (65° to 205°C), preferably from 200° to 300°F (90° to 150°C), under sufficient pressure to maintain the 3 reactants in liquid phase, generally from 0 to 150 psig (1 to 10 atmospheres). The contacting is conducted for a period of 0.5 to 25 hours and preferably from 3 to 20 hours. An inert reaction solvent may be employed or the reaction can be conducted with an excess of one or more of the reactants. The solvents, if employed, should preferably be a mutual solvent or possess good solvency for the reactants. Exemplary reaction solvents include aliphatic alcohols having from 1 to 8 carbons such as isobutyl alcohol, pentanol, isopropyl alcohol, etc.

The amount of reactants charged to the reaction vessel usually varies from 0.5 to 4 molar parts of formaldehyde and from 0.5 to 4 molar parts of amine for each molar part of alkylphenol. The preferred molar ratio varies from 1.5 to 3.4 parts of formaldehyde and from 1.5 to 3 parts of amine per part of alkylphenol.

Mono- or Polyurea Thickening Agent

The mono- or polyurea thickening agent as employed in this invention is a water- and oil-insoluble organic compound having a molecular weight between about 350 and 2500 AMU's and having at least one ureido group, and preferably having an average between about 2 and 8 ureido groups. A uriedo group as referred to herein is defined as

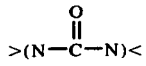

A particularly preferred polyurea compound has an average between 3 and 4 ureido groups and has a molecular weight between about 600 and 1200 AMU's.

The mono- or polyurea compounds are prepared by reacting the following components:

I. a diisocyanate having the formula OCN-R-NCO, wherein R is a hydrocarbylene having from 2 to 30 carbons, preferably an arylene having from 6 to 15 carbons, and more preferably an arylene having 7 carbons;

II. A polyamine having a total of 2 to 40 carbons and having the formula:

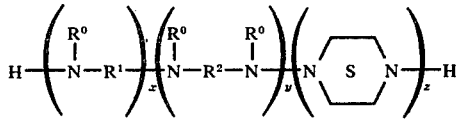

wherein $R^1$ and $R^2$ are the same or different type of hydrocarbylenes having from 1 to 20 carbons, preferably from 2 to 10 carbons, and more preferably from 2 to 4 carbons; $R^o$ is selected from hydrogen or a $C_1$–$C_4$ alkyl and preferably hydrogen; $x$ is an integer from 0 to 2; $z$ is an integer from 0 to 1; and $y$ is an integer equal to 1 when $z$ is 0 and 0 when $z$ is 1; and III. A monofunctional compound selected from the group consisting of monoisocyanate having from 1 to 30 carbons, preferably from 10 to 24 carbons, a monoamine having from 1 to 30 carbons, preferably from 10 to 24 carbons, or mixtures thereof.

The reaction can be conducted by contacting the 3 reactants in a suitable reaction vessel at a temperature between about 60° to 320°F (15° to 160°C), preferably from 100° to 300°F (38° to 150°C), for a period from 0.5 to 5 hours, and preferably from 1 to 3 hours. The molar ratio of the reactants present usually varies from 0.1–2 molar part of monoamine or monoisocyanate and 0–2 molar part of polyamine for each molar part of diisocyanate. When the monoamine is employed, the molar quantities are preferably ($n$+1) molar part of diisocyanate, ($n$) molar part of polyamine and 2 molar parts of monoamine. When the monoisocyanate is employed, the molar quantities are preferably (n) molar parts of diisocyanate, ($n$+1) molar parts of polyamine and 2 molar parts of monoisocyanate.

A particularly preferred class of mono- or polyurea compounds has structures defined by the following general formulas:

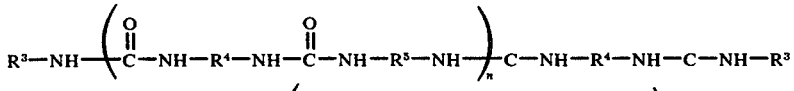

(1)

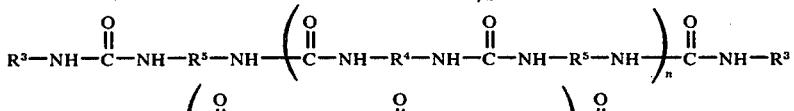

(2)

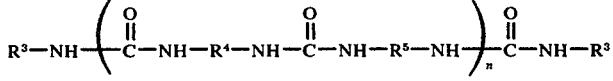

(3)

wherein $n$ is an integer from 0 to 3; $R^3$ is the same or different hydrocarbyl having from 1 to 30 carbon atoms, preferably from 10 to 24 carbons; $R^4$ is the same or different hydrocarbylene having from 2 to 30 carbon atoms, preferably an arylene having from 6 to 15 carbons; and $R^5$ is the same or different hydrocarbylene having from 1 to 30 carbon atoms, preferably from 2 to 10 carbons.

As referred to herein, hydrocarbyl is a monovalent organic radical composed of hydrogen and carbon and may be aliphatic, aromatic or alicyclic or combinations thereof, e.g., aralkyl, alkyl, aryl, cycloalkyl, alkylcycloalkyl, etc., and may be saturated or olefinically unsaturated (one or more doublebonded carbons, conjugated or nonconjugated). The hydrocarbylene, as defined in $R^4$ and $R^5$ above, is a divalent hydrocarbon radical which may be aliphatic, alicyclic, aromatic or combinations thereof, e.g., alkylaryl, aralkyl, alkylcycloalkyl, cycloalkylaryl, etc., having its 2 free valences on different carbon atoms.

The mono- or polyureas having the structure presented in Formula 1 above are prepared by reacting ($n$+1) molar parts of diisocyanate with 2 molar parts of a monoamine and ($n$) molar parts of a diamine. (When $n = 0$ in the above Formula 1, the diamine is deleted). Mono- or polyureas having the structure presented in Formula 2 above are prepared by reacting (n) molar parts of a diisocyanate with ($n$+1) molar parts of a diamine and two molar parts of a monoisocyanate. (When $n = 0$ in the above Formula 2, the diisocyanate is deleted). Mono- or polyureas having the structure presented in Formula 3 above are prepared by reacting ($n$) molar parts of a diisocyanate with ($n$) molar parts of a diamine and one molar part of a monoisocyanate and one molar part of a monoamine. (When $n = 0$ in Formula 3, both the diisocyanate and diamine are deleted).

In preparing the above mono- or polyureas, the desired reactants (diisocyanate, monoisocyanate, diamine and monoamine) are admixed within a suitable reaction vessel in the proper proportions. The reaction may proceed without the presence of a catalyst and is initiated by merely contacting the component reactants under conditions conducive for the reaction. Typical reaction temperatures range from 65° to 350°F (20° to 175°C) under atmospheric pressure. The reaction itself is exothermic and, accordingly, by initiating the reaction at room temperature, elevated temperatures are obtained. However, external heating or cooling may be desirable.

The mono- or polyurea thickener will usually be present in the grease composition at a concentration of 0.5 to 20 weight percent, preferably from 3 to 10 weight percent, and sufficient to thicken the final composition to the consistency of grease.

Mono- or Polyurea Reactants

The monoamine or monoisocyanate used in the formulation of the mono- or polyurea will form the terminal end groups. These terminal end groups will have from 1 to 30 carbon atoms, but are preferably from 5 to 28 carbons, and more desirably from 6 to 25 carbon atoms.

Illustrative of various monoamines are pentylamine, hexylamine, heptylamine, octylamine, decylamine, dodecylamine, tetradecylamine, hexadecylamine, octadecylamine, eiscosylamine, dodecenylamine, hexadecenylamine, octadecenylamine, octadecadienylamine, abietylamine, aniline, toluidine, naphthylamine, cumylamine, bornylamine, fencylamine, t-butyl aniline, benzylamine, beta-phenethylamine, etc. Particularly preferred amines are prepared from natural oils or fats or from straight-chain acids derived therefrom. These starting materials may be converted to amides by reactions with ammonia and the amides dehydrated to give nitriles. The nitriles are then reduced to give the desired amines. Exemplary amines prepared by the method include stearylamine, laurylamine, palmitylamine, oleylamine, petroselinylamine, linoleylamine, linolenylamine, eleostearylamine, etc. The unsaturated amines are particularly preferred.

Illustrative of monoisocyanates are hexylisocyanate, decylisocyanate, dodecylisocyanate, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines, which form internal hydrocarbon bridges between the ureido groups, usually contain from 2 to 40 carbon atoms, preferably from 2 to 30 carbon atoms, and more desirably from 2 to 20 carbon atoms. Exemplary polyamines include diamines such as ethylenediamine, propylenediamine, butylenediamine, hexylenediamine, dodecylenediamine, octylenediamine, hexadecylenediamine, cyclohexylenediamine, cyclooctylenediamine, phenylenediamine, tolylenediamine, xylenediamine, dianiline methane, ditoluidinemethane, bis(aniline) bis(toluidine), piperazine, etc.

Triamines such as N-amino-ethyl piperazine, dietylenetriamine, dipropylenetriamine, tert-N-methyldiethyltriamine, etc., and higher polyamines such as triethylenetetraamine, tetraethylenepentamine, pentaethylenehexamine, etc.

Representative examples of diisocyanates include hexylenediisocyanate, decylenediisocyanate, octadecylenediisocyanate, phenylenediisocyanate, tolylenediisocyanate, bis(diphenylisocyanate), methylene bis(phenylisocyanate), etc.

Another class of mono- or polyurea compounds which may be successfully employed in the practice of this invention include the following:

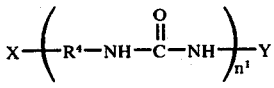

wherein $n^1$ is an integer of 1 to 3, $R^4$ is defined supra, X and Y are monovalent radicals selected from Table I below.

TABLE I

| X | Y |
|---|---|
| 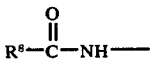 | 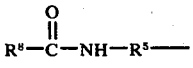 |
| 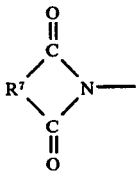 | 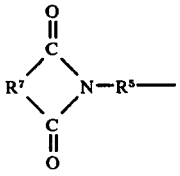 |
| | $R^6$— |

In Table I, $R^5$ is defined supra, $R^6$ is the same as $R^3$ and is defined supra, $R^7$ is selected from the group consisting of arylene radicals of 6 to 16 carbon atoms and alkenyl groups of 2 to 30 carbon atoms, and $R^8$ is selected from the group consisting of alkyl radicals having from 10 to 30 carbon atoms and aryl radicals having from 6 to 16 carbon atoms.

Mono- or polyurea compounds described by the above Formula 4 can be described as amides and imides of mono-, di- and triureas. These materials are formed by reacting in the selected proportions suitable carboxylic acids or internal carboxylic anhydrides with a diisocyanate and an amine or diamine. The mono- or polyurea compounds are prepared by blending the several reactants together in a suitable reaction vessel and heating them to a temperature ranging from 70°F to 400°F for a period sufficient to cause formation of the compound, generally from 5 minutes to 1 hour.

Suitable carboxylic acids include aliphatic carboxylic acids of about 11 to 31 carbon atoms and aromatic carboxylic acids of 7 to 17 carbon atoms. Examples of suitable acids include aliphatic acids such as lauric, myristic, palmitic, margaric, stearic, arachidic, behenic, lignoceric acid, etc.; and aromatic acids such as benzoic acid, 1-naphthoic acid, 2-naphthoic acid, phenylacetic acid, hydrocinnamic acid, cinnamic acid, mandelic acid, etc. Suitable anhydrides which may be employed are those derived from dibasic acids which form a cyclic anhydride structure, for example succinic anhydride, maleic anhydride, phthalic anhydride, etc. Substituted anhydrides, such as alkenyl succinic anhydride of up to 30 carbon atoms are further examples of suitable materials.

Examples of suitable diisocyanates, monoisocyanates, monoamines and diamines are described supra.

The mono- or polyurea compounds are generally mixtures of compounds having structures wherein $n^1$ varies from 0 to 4, or $n^1$ from 1 to 3, existent within the grease composition at the same time. For example, when a monoamine, a diisocyanate and a diamine are concurrently present within the reaction zone, as in the preparation of mono- or polyureas having the structure shown in Formula 2, some of the monoamine may react with both sides of the diisocyanate to form a diurea. In addition to the formulation of diurea, simultaneous reactions can be occurring to form the tri-, tetra-, penta-, hexa-, octa-, etc., ureas. Particularly good results have been realized when the polyurea compound has an average of 4 ureido groups.

The lubricating oil generally has a viscosity of 35 to 55,000 SUS at 100°F and preferably from 20 to 500 SUS at a temperature of 210°F.

Another component present within the grease is an alkaline earth metal aliphatic monocarboxylate or carbonate. By incorporating the metal carboxylate or carbonate into the grease composition, the total amount of mono- or polyurea required to thicken the grease to the desired consistency can be substantially reduced. Moreover, the presence of the metal carboxylate or carbonate imparts good extreme-pressure properties to the grease.

The alkaline earth metal carboxylate has from 1 to 3 carbons. The alkaline earth metal acetates are preferred. Any of the alkaline earth metals can be employed herein, e.g., magnesium calcium, strontium, barium, etc. However, calcium is the most preferred. The carboxylate group preferably has from 1 to 2 carbon atoms and more preferably 2 carbon atoms. Exemplary compounds which may be successfully employed herein include calcium carbonate, calcium formate, barium formate, barium carbonate, magnesium formate, magnesium acetate, magnesium carbonate, calcium acetate, strontium acetate, barium acetate, calcium propionate, barium propionate, magnesium propionate, etc.

The amount of alkaline earth metal aliphatic monocarboxylate or carbonate present within the grease composition may vary depending upon the lubricating property desired, the particular mono- or polyurea constituent selected, the type of alkaline earth metal carboxylate or carbonate selected, etc. However, generally the metal carboxylate or carbonate will range from 3 to 30 weight percent of the final grease composition, preferably between about 4 and 15 weight percent. The ratio of alkaline earth metal carboxylate or carbonate to the mono- or polyurea constituent will also vary depending upon the aforementioned conditions, but will generally range on a weight basis from 1 to 15 parts of metal carboxylate or carbonate per part of mono- or polyurea and preferably from 3 to 7 parts per part of mono- or polyurea.

Preparation of Grease Composition

The greases exhibiting the superior properties of this invention are preferably prepared by the in-situ production of the mono- or polyurea and metal carboxylate or carbonate within the lubricating oil. In this embodiment, the lubricating oil is charged to the grease kettle along with the mono- or polyurea precursors, i.e., the reactants which combine to form the mono- or polyurea. After the formation of the mono- or polyurea compounds, the grease kettle is charged with an alkaline earth metal hydroxide or oxide and a carboxylic acid or carbon dioxide. The ratio of alkaline earth metal hydroxide to carboxylic acid or carbon dioxide on an equivalent basis can vary from 1 to 4:1 and is preferably between 1 and 2:1. The kettle is maintained at a temperature between 70°F (20°C) and 150°F (65°C) during the process to effect the neutralization reaction of the alkaline earth metal hydroxide or oxide and the carboxylic acid or carbon dioxide. During the reaction with the carboxylic acid water is released and is preferably moved from the system by applying a slight vacuum on the kettle of 20 to 29 inches of mercury and heating to about 212°F (100°C) and higher.

The Mannich base made can then be added to the grease composition to the proper concentration. Generally from 0.1 to 10 weight percent of the Mannich base will be present in the grease composition for best results and more preferably from 0.5 to 2 weight percent.

The grease composition can be further processed by subjecting it to shear hardening. Shear hardening is performed by milling the grease in an extrusion-type mill under elevated pressures. This milling improves the dispersion of the polyurea and metal carboxylate throughout the base oil, resulting in a grease of greatly improved consistency.

Other Additives

In addition to the thickening agents, alkaline earth metal carboxylate and Mannich base rust inhibitor, other additives may be successfully employed within the grease composition of this invention without affecting its high stability and performance over a wide temperature scale. One type of additive is an antioxidant or oxidation inhibitor. This type of additive is employed to prevent varnish and sludge formation on metal parts and to inhibit corrosion of alloy bearings. Particularly useful grease antioxidants include phenyl-alpha-naphthylamine, bis(alkylphenyl)amine, N,N-diphenyl-p-phenylenediamine, 2,2,4-trimethylhydroquinoline oligomer, bis(4-isopropylaminophenyl)ether, N-acyl-p-aminophenol, N-acylphenothiazines, N-hydrocarbylamides of ethylenediamine tetraacetic acid, alkylphenol-formaldehyde-amine polycondensates, etc.

Another additive which may be incorporated into the grease composition of this invention is an anticorrodant. The anticorrodant is employed to inhibit oxidation so that the formation of acidic bodies is suppressed and to form films over the metal surfaces which decrease the effect of corrosive materials on exposed metallic parts. A particularly effective corrosion inhibitor is sodium nitrite.

Another type of additive which may be employed herein is a metal deactivator. This type of additive is employed to prevent or counteract catalytic effects of metal on oxidation generally by forming catalytically inactive complexes with soluble or insoluble metal ions. Typical metal deactivators include complex organic nitrogen- and sulfur-containing compounds such as certain complex amines and sulfides. An exemplary metal deactivator is mercaptobenzothiazole.

In addition to the above, several other grease additives may be employed in the practice of this invention and include stabilizers, tackiness agents, dropping point improvers, lubricating agents, color correctors, odor control agents, etc.

The following examples are presented to illustrate the practice of specific embodiments of this invention and should not be interpreted as limitations upon the scope of the invention.

EXAMPLES

EXAMPLE 1

This example is presented to illustrate the preparation of a preferred mono- or polyurea/alkaline earth metal carboxylate grease. A 48 liter stainless-steel reaction vessel equipped with a stirrer is charged with 7500 grams of a blend of a paraffinic and naphthenic oil having a viscosity of 78 SUS at 210°F (99°C), hereinafter referred to as "base oil," 880 grams of tall oil fatty amine and 92 grams of ethylene diamine. The contents of the vessel are stirred for 20 minutes at 130°F (55°C) and thereafter admixed with 6000 grams of base oil and 548 grams of tolylene diisocyanate. The vessel is agitated and held at a temperature of 150°F (65°C) for a 30-minute period.

The vessel contents are thereafter milled in an extrusion-type mill at a pressure of 7500 psi and then heated to 200°F (93°C). A small sample of the grease is analyzed and trace amounts of diisocyanate are detected. An additional 40 grams of ethylenediamine are charged to the vessel and mixed with the milled grease for a period of 10 minutes at a temperature of 210°F (99°C). At the end of the 10-minute period, the vessel is cooled to 150°F (65°C) and 5000 grams of additional base oil with 2480 grams of hydrated line [$Ca(OH)_2$] are charged to the vessel. The lime and base oil are admixed with the previously milled grease for 5 minutes, at which time an additional 5460 grams of base oil and 2800 grams of acetic acid are slowly charged to the vessel over a 25-minute period. The admixture is agitated for 30 minutes at 150°F (65°C) to assure that the neutralization reaction between the calcium hydroxide and acetic acid is complete. Thereafter, an aqueous solution of 320 grams of a commercial sodium nitrite rust inhibitor is charged to the vessel and the contents milled at 7500 psi. The grease is heated to 250°F (120°C) to remove water and then cooled to 160°F (70°C). The grease is then admixed with 8290 grams of base oil and recycled through a mill at a pressure of 7500 psi. The product grease has an undisturbed penetration ($P_o$) of 232 and after 60 strokes a worked penetration ($P_{60}$) of 286 (ASTM 217). The ASTM dropping point is about 460°F (237°C) (ASTM-D-2265).

A sample of the grease is calculated to have the following: calcium acetate, 11.7 wt.%; polyurea (see below), 3.8 wt.%; base oil, 82 wt.%.

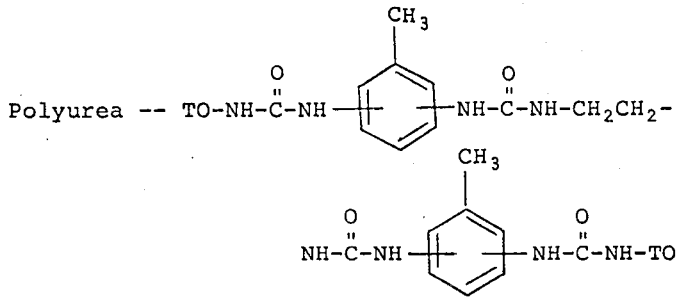

wherein TO is a tall oil radical.

EXAMPLE 2

Preparations of exemplary Mannich bases of the type useful in this invention are illustrated in this example.

A 4000-gallon reactor is charged with 12,000 pounds of diethanolamine and 3750 pounds of paraformaldehyde. The temperature is 85°F (30°C) during the charging step. Thereafter 6150 pounds of p-cresol at a temperature of 150°F (65°C) is charged to the reactor. 825 gallons of isobutyl alcohol are charged and the mixture heated to 275°F (135°C) under a pressure of 30–50 psig (2–3.4 atmospheres). These conditions are maintained for 5 hours. The reactor is cooled to 180°F (82°C) and the alcohol and water are stripped from the system. The reaction product is designated 2A. Another product designated as 2B was prepared in substantially the same manner except that mixed *m+p*-cresols (having the following analysis: 64.3% *m+p*-cresols, 16.5% xylenols, 12% *m+p*-ethylphenol, 0.4% phenol and 3.7% balance) instead of the p-cresol and the charging was done at 120°F (49°C) and after reaction the product was cooled to 160°F (70°C) before distilling off the alcohol and water at 300°F (150°C). The analyses of the products reveal the following:

| | Product 2A | Product 2B |
|---|---|---|
| Nitrogen, wt.% | 7.7 | 8.0 |
| Alkalinity value, mg KOH/gram | 309 | 316 |
| Specific gravity (lb/gal) | 1.168 | 1.178 |
| Viscosity, SUS at 210°F (99°C) | 699 | 1516 |
| Ash, wt.% | 0.004 | Nil |

EXAMPLE 3

This example is presented to illustrate the effectiveness of the Mannich bases of this invention as compared to other comparable Mannich bases. The preparations of the present Mannich bases are substantially the same as Products 2A and 2B described in Example 2, the reactants having been present in a ratio of 2 molar parts of formaldehyde and 2 molar parts of diethanolamine for each molar part of cresol or mixed cresols employed. The Mannich bases are referred to as p-Cresol/$CH_2O$/DEA (Product 2A) and mixed cresol/$CH_2O$/DEA (Product 2B). A comparison Mannich base is prepared substantially as above except that tetrapropenylphenol is substituted for the cresol above. It was made by reacting 4.4 molar parts of formaldehyde and 4 molar parts of diethanolamine for each molar part of tetrapropenylphenol. This base is referred to as Alkphenol/$CH_2O$/DEA. A fourth Mannich base is prepared by replacing cresol with phenol and using 4.4 molar parts of formaldehyde and 4 molar parts of diethanolamine for each molar part of phenol. This Mannich base is referred to as Phneol/$CH_2O$/-DEA. A 50 Mannich base is prepared by replacing cresol with amyl phenol and using 1.4 molar parts of formaldehyde and 1.08 molar parts of diethanolamine for each molar part of amyl phenol.

Thereafter, varying amounts of the Mannich bases are incorporated into a grease prepared substantially by the method of Example 1 except containing 3.9 weight percent of the polyurea thickener, 13.6 weight percent of the calcium acetate, about 1 weight percent $NaNO_2$, and a blend of paraffinic base oils having a viscosity of 55 SUS at 210°F (99°C).

The following Table II illustrates the effect of the Mannich bases on the hardness of the grease as measured by ASTM-D-217 (worked penetration). On those greases which were not substantially affected, a modified ASTM-D-1743 rust test is performed with 1% brine and 99% distilled water. The rust test rating is 0 = no rust and 5 = very rusty, with intermediate values between 0 and 5 representing increasing degrees of rust. This rating system is more fully described in IR220 (British Institute of Petroleum) and is sometimes called the Emcor rating system. Ratings are determined after the bearing is stored for 1 day at 125°F (52°C).

In addition, the grease compositions were felt and the presence of grit determined. Those greases not having any grit to the feel are designated as "smooth". Those greases having a grit are designated as "gritty."

TABLE II

| Experiment | Additive Employed Type | Conc. (wt.%) | Worked Pen. ($P_{60}$) | Rust Rating | Grit |
|---|---|---|---|---|---|
| 1 | None | | 269 | 3+ | Smooth |
| 2 | p-Cresol/$CH_2O$/DEA | 2 | 285 | 0 | Smooth |
| 3 | Mixed Cresol/$CH_2O$/DEA | 2 | 261 | 0 | Smooth |
| 4 | Alkphenol/$CH_2O$/DEA | 5 | 439 | | |
| 5 | Alkphenol/$CH_2O$/DEA | 2.5 | 439 | | |
| 6 | Phenol/$CH_2O$/DEA | 5 | 311 | 0 | Gritty |
| 7 | Phenol/$CH_2O$/DEA | 2.5 | 313 | 0 | Gritty |
| 8 | Phenol/$CH_2O$/DEA | 2 | 286 | 0 | Gritty |
| 9 | Amylphenol/$CH_2O$/DEA | 1 | 285 | 2,3 | Smooth |
| 10 | Amylphenol/$CH_2O$/DEA | 2 | — | — | Smooth |

The data shows the superiority of claimed Mannich bases prepared from short-chain alkyl-substituted phenols over the unsubstituted phenol Mannich bases which show grit formation and the long-chain alkyl phenol Mannich bases which show increased penetration, i.e., softness for the grease.

What is claimed is:

1. A grease composition comprising: (1) a major portion of an oil of lubricating viscosity; (2) from 0.5 to 20 weight percent of a water- and oil-insoluble mono- or polyurea thickening agent having a molecular weight between about 350 and 2500; (3) from 3 to 30 weight percent of an alkaline earth metal carbonate or aliphatic monocarboxylate having from 1 to 3 carbons; and (4) from 0.1 to 10 weight percent of a Mannich base prepared by reacting alkylphenol having from 1 to 4 carbon atoms in the alkyl groups with formaldehyde and an amine selected from the class consisting of dialkanolamine, N,N-dialkanolalkylenediamine and dialkylamine.

2. The grease composition defined in claim 1 wherein said amine is N,N-diethanolalkylenediamine of the formula:

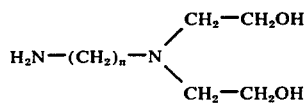

wherein $n$ is an integer from 1 to 4.

3. The grease composition defined in claim 1 wherein said Mannich base is prepared by reacting 0.5 to 4 molar parts of formaldehyde and 0.5 to 4 molar parts of said amine for each molar part of said alkylphenol.

4. The grease composition defined in claim 3 wherein said amine is diethanolamine and wherein said alkylphenol is p-cresol, m-cresol or mixtures thereof.

5. The grease composition defined in claim 4 wherein the Mannich base is prepared by reacting 1.5 to 3.4 molar parts of formaldehyde and 1.5 to 3 molar parts of diethanolamine with each molar part of said alkylphenol.

6. A grease composition comprising: (1) a major portion of an oil of lubricating viscosity; (2) from 0.5 to 20 weight percent of a mono- or polyurea thickener prepared by reacting a. a diisocyanate having the formula ON-C—R—CNO, wherein R is a hydrocarbylene having from 2 to 30 carbons;

b. a polyamine aving the formula

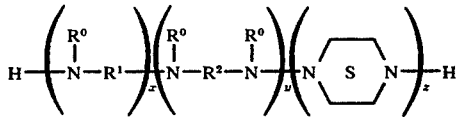

wherein $R^o$ is selected from the group consisting of hydrogen, a $C_1$–$C_4$ alkyl or mixtures thereof; $R^1$ and $R^2$ are the same or different type of hydrocarbylene having from 18 to 20 carbons; $x$ is an integer from 0 to 2; $z$ is an integer from 0 to 1; and $y$ is an integer equal to 1 when $z$ is 0 and 0 when $z$ is 1;

c. a monofunctional compound selected from the group consisting of $C_1$–$C_{30}$ monoisocyanate, $C_1$–$C_{30}$ monoamines or mixtures thereof;

3. from 3 to 30 weight percent of an alkaline earth metal aliphatic monocarboxylate having from 1 to 3 carbons; and (4) from 0.1 to 10 weight percent of a Mannich base prepared by reacting cresol with formaldehyde and an amine selected from the class consisting of diethanolamine, N-N-diethanolalkylenediamine and diethylamine.

7. The grease composition defined in claim 6 wherein said diisocyanate is tolylene diisocyanate, said polyamine is ethylenediamine and said monofunctional compound is a $C_{10}$–$C_{24}$ monoamine.

8. The grease composition defined in claim 7 wherein 2 molar parts of said diisocyanate are reacted with 1 molar part of said polyamine and 2 molar parts of said monoamine.

9. The grease composition defined in claim 6 wherein said Mannich base is prepared by reacting 0.5 to 4 molar parts of formaldehyde and 0.5 to 4 molar parts of said amine for each molar part of said cresol, and wherein said cresol is p-cresol, m-cresol or mixtures thereof.

10. The grease composition defined in claim 9 wherein said amine is diethanolamine.

11. The grease composition defined in claim 9 wherein the Mannich base is prepared by reacting 1.5 to 3.4 molar parts of formaldehyde and 1.5 to 3 molar parts of diethanolamine with each molar part of said cresol.

12. The grease composition defined in claim 6 wherein said alkaline earth metal monocarboxylate is calcium acetate.

* * * * *